United States Patent [19]

Barbour

[11] Patent Number: 4,521,832

[45] Date of Patent: Jun. 4, 1985

[54] WRIST STRAP ILLUMINATING DEVICE

[76] Inventor: Bruce E. Barbour, 41-37 52nd St., Woodside, N.Y. 11377

[21] Appl. No.: 622,003

[22] Filed: Jun. 18, 1984

[51] Int. Cl.[3] ..... F21L 15/08

[52] U.S. Cl. ..... 362/103; 362/184; 362/190; 362/208; 362/251; 362/295; 200/60

[58] Field of Search ..... 362/103, 184, 190, 208, 362/251, 295; 200/60

[56] References Cited

U.S. PATENT DOCUMENTS 3,321,617 5/1967 Santana ..... 362/103

4,112,482 9/1978 Powell ..... 362/108

4,173,201 11/1979 Chao et al. ..... 362/103 X 4,283,756 8/1981 Beamon ..... 362/108

*Primary Examiner*—Stephen J. Lechert, Jr.

[57] ABSTRACT

This illuminating device is designed to distribute light in a working area, without the user employing a flashlight, etc. Primarily, it consists of a wrist strap of foam plastic, having a self-contained replaceable battery, which is held in place by velcro fasteners. It further includes a multiple number of spaced bulbs, which provide light for the user to work by while his hand is free to be employed for work, and the strap is adjustable by velcro fasteners.

2 Claims, 5 Drawing Figures

WRIST STRAP ILLUMINATING DEVICE

This invention relates to flashlights, and more particularly, to a wrist strap illuminating device.

The principal object of this invention is to provide a wrist strap illuminating device, which will be employed to produce light without the need of holding an article, such as a flashlight.

Another object of this invention is to provide a wrist strap illuminating device, which will be of such design, as to employ a plurality of small light bulbs therein, facing forward in a circle, and the device will include self-contained switch and battery means for its operation.

Another object of this invention is to provide a wrist strap illuminating device, which will employ adjustment means, so as to be moved forward and rearward on the user's wrist, as well as enabling it to fit various wrist sizes.

A further object of this invention is to provide a wrist strap illuminating device, which will be employed by mechanics, who will no longer have to move around with extension lights, and it will be useful to plumbers, useful to households when changing a fuse, bleeding radiators, taking out garbage, collecting wood for the stove, etc. It will also be excellent for joggers when jogging in unlighted areas, and it may further be employed by campers when setting up their tent and searching for objects therein.

A still further object of this invention is to provide a wrist strap illuminating device, which will be useful to soldiers in the field at night, and it may also be adaptable to be employed in spacesuits for use in the construction of a space station, etc.

Other objects of the invention are to provide a wrist strap illuminating device, which will be simple in design, inexpensive to manufacture, rugged in construction, and easy to use.

These and other objects will become readily evident, upon a study of the specification and the accompanying drawing, in which.

Figure 1:
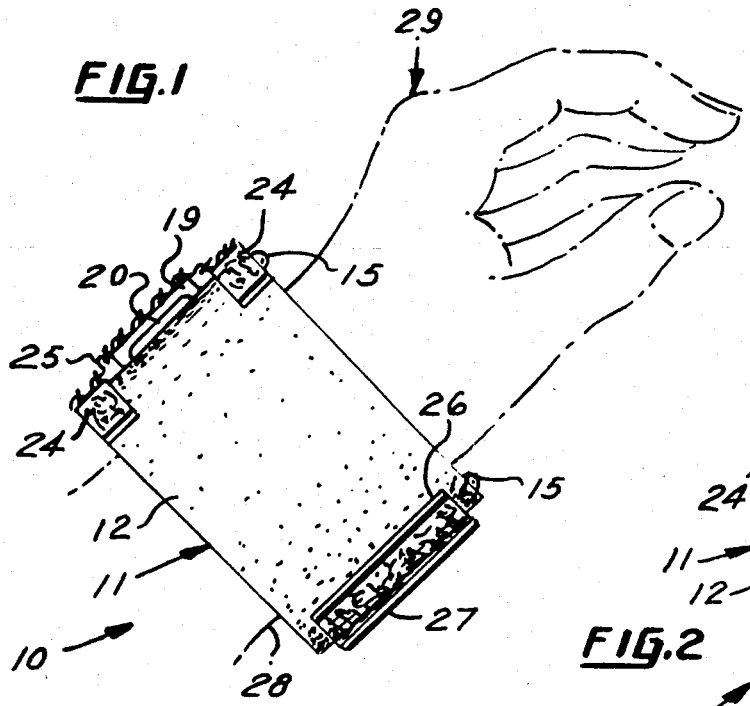
FIG. 1 is a side view of the present invention, showing the removable battery holder fastener strip in section, and illustrating the user's wrist and hand, in phantom.
Figure 2:
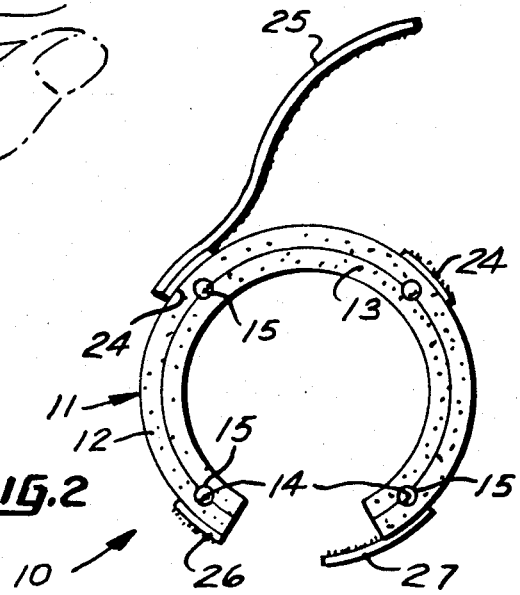
FIG. 2 is a front end view of the invention, shown in elevation and open condition, with the battery removed therefrom.
Figure 3:
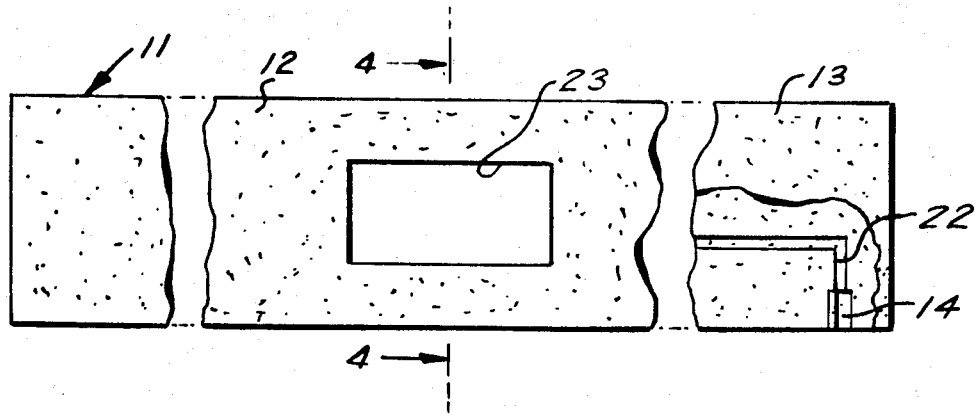
FIG. 3 is a fragmentary plan view of the strap of the invention, shown in flat condition and partly broken away.
Figure 4:
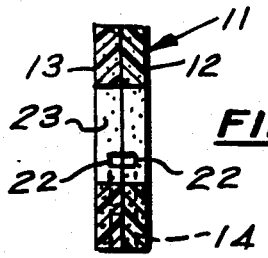
FIG. 4 is a cross-sectional view, taken along the line 4—4 of FIG. 3.
Figure 5:
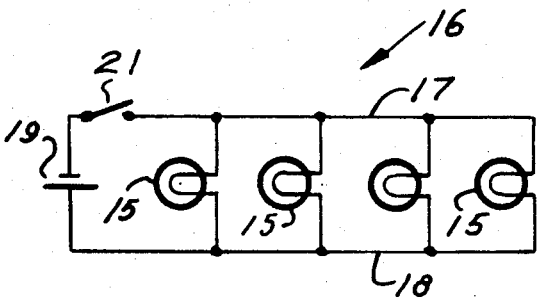
FIG. 5 is a schematic wiring diagram of the invention.

Accordingly, a device 10 is shown to include a main body 11, formed of a pair of foam plastic strips 12 and 13, which are rectangular in cross sectional configuration. Strips 12 and 13 are fixedly secured to each other by a suitable adhesive, and a plurality of semi-circular recesses in one face of strips 12 and 13, form openings 14 in one longitudinal side edge of main body 11, which receive bulbs 15 for providing light. In the circuit 16, the bulbs 15 are wired in parallel across wires 17 and 18, in common fashion, and circuit 16 includes a nine volt battery 19, in this instance, and is opened and closed by means of a typical battery snap 20, which is on the on-off switch 21 indicated in FIG. 5 of the drawing. The openings 14 in main body 11, intersect with passageways 22, recessed in strips 11 and 12, one of which is shown, and passageways 22 serve to receive wires 17 and 18. Battery 19 is removably received within cut-out opening 23 through strips 11 and 12, and a pair of spaced fastener strips 24, are fixedly secured adjacent to opening 23, on the outside of strip 12, in a suitable manner. Strips 24 removably engage with a third strip 25, which is provided for engaging with and holding battery 19 in place within opening 23. Fastener strips 24 and 25, are of the hook and loop type, which are common in the art, and a similar pair of mating fastener strips 26 and 27 are provided, for adjustably securing the open ends of main body 11 together on a person's wrist 28.

In use, main body 11 is placed on the user's wrist 28, with the battery 19 in opening 23, and held therein, by prior engagement of fastener strips 24 and 25. The battery snap 20, which is connected to wires 17 and 18, is also engaged with the mating snap of the battery 19, prior to closing strips 24 and 25 together, which places the circuit 16 in the on condition. The ends of main body 11 are then fastened together by the engagement of fastener strips 26 and 27, and thus, the user will use the light from the bulbs 15 to illuminate the area in which his hand is placed.

While various changes may be made in the detailed structure, such changes will be within the spirit and scope of the present invention, as defined by the appended claims.

What is claimed is:

1. A wrist strap illuminating device, comprising, in combination, a main body, an electrical circuit received in said main body with a battery, battery snap switch means received in said main body and a plurality of mating velcro fastener strips secured to said main body.

2. The combination as set forth in claim 1, wherein said main body includes a foam plastic outer strip and a foam plastic inner strip, which are suitably fixedly secured together at one of their faces, and four equally space openings are provided in one longitudinal side edge of main body defined by said outer strip and said inner strip, and the openings removably receive a bulb each, which is wired in said electrical circuit, and a passageway cut-out is provided longitudinally in said faces and receives a pair of wires of said circuit which are wired to each said bulb, and said battery snap switch means provides for closing said circuit to said battery, when engaged with a similar battery snap which is manufactured into said battery, and when said device is secured to the wearer's wrist, each said bulb when lighted, produces a substantially circular light pattern forward towards the work and the wearer's fingers, and said battery is removably received within an opening included through both said outer strip and said inner strip, and one of said plurality of mating velcro fasteners removably engages with one pair of said plurality of mating vlecro fasteners, and said one pair is suitably fixedly secured to the outer surface of said outer strip, adjacent to the opening receiving said battery, and said one of said plurality of mating velcro fasteners engages with the outer periphery of said battery and renders said battery secure within its opening through said main body.

* * * * *